US007029386B2

(12) United States Patent
Young

(10) Patent No.: US 7,029,386 B2
(45) Date of Patent: Apr. 18, 2006

(54) RETAINING RING ASSEMBLY FOR USE IN CHEMICAL MECHANICAL POLISHING

(75) Inventor: Richard T. Young, Desert Hot Springs, CA (US)

(73) Assignee: R & B Plastics, Inc., Anaheim, CA (US)

( * ) Notice: Subject to any disclaimer, the term of this patent is extended or adjusted under 35 U.S.C. 154(b) by 0 days.

(21) Appl. No.: 10/865,626

(22) Filed: Jun. 10, 2004

(65) Prior Publication Data

US 2005/0277375 A1 Dec. 15, 2005

(51) Int. Cl.
*B24B 21/18* (2006.01)
*B24B 33/00* (2006.01)
*B24B 47/26* (2006.01)
*B24B 55/00* (2006.01)

(52) U.S. Cl. ..... 451/442; 451/285; 451/287; 451/41

(58) Field of Classification Search ..... 451/442, 451/285, 287, 290, 324, 402
See application file for complete search history.

(56) References Cited

U.S. PATENT DOCUMENTS 3,177,464 A * 4/1965 Solorow et al. ..... 439/695
4,872,710 A * 10/1989 Konecny et al. ..... 285/81
4,906,031 A * 3/1990 Vyse ..... 285/318
5,993,302 A * 11/1999 Chen et al. ..... 451/285
6,080,040 A * 6/2000 Appel et al. ..... 451/10
6,186,880 B1 * 2/2001 Gonzalez et al. ..... 451/397
6,251,215 B1 6/2001 Zuniga et al.
6,789,826 B1 * 9/2004 Helgenberg et al. ... 292/341.15
6,866,571 B1 * 3/2005 Held ..... 451/390
2002/0037693 A1 * 3/2002 Lougher et al. ..... 451/398
2004/0219870 A1 * 11/2004 Chen et al. ..... 451/422
2005/0001423 A1 * 1/2005 Vila ..... 285/223

* cited by examiner

*Primary Examiner*—Joseph J. Hail, III
*Assistant Examiner*—Bryan R. Muller
(74) *Attorney, Agent, or Firm*—Holland & Knight LLP

(57) ABSTRACT

A retaining ring assembly for use in chemical mechanical polishing that includes an annular plastic retaining ring portion defining an annular projection thereon, an annular metal backing defining an annular channel therein for receiving the projection and a pair of elongated spring members concentrically disposed about the annular projection on the retaining ring. The channel in the backing is sized so as to receive the annular projection on the retaining ring and spring members therein upon the retaining ring being urged against the backing whereupon the spring members bear against the projection on the retaining ring and portions of the annular backing so as to releasably secure the retaining ring to the backing such that the retaining ring can be replaced upon becoming worn during use and the metal backing can be reused.

4 Claims, 2 Drawing Sheets

RETAINING RING ASSEMBLY FOR USE IN CHEMICAL MECHANICAL POLISHING

BACKGROUND OF THE INVENTION

The present invention relates to a retaining ring assembly for use on a carrier head in a chemical mechanical polishing apparatus. Chemical mechanical polishers are used in several applications including the manufacture of integrated circuits where they provide the silicon wafer substrates with a smooth flat finish prior to and during the sequential deposition of conductive, semi-conductive and/or insulative layers thereon. The polishing is accomplished by placing the semi-conductor wafer on a carrier head of the polisher which holds the wafer using a combination of vacuum suction or other means to contact the rear side of the wafer and a retaining lip or ring around the edge of the wafer to keep the wafer centered on the carrier head. The front side of the wafer is then contacted by a rotating polishing pad in a chemically reactive slurry that polishes the outermost surface of the wafer to a flat smooth surface. During the polishing, the carrier head and retaining ring assembly maintain a bias force between the surface of the substrate and the rotating polishing pad. The movement of the slurry-wetted polishing pad across the surface of the substrate causes material to be mechanically and chemically polished (removed) from the face of the substrate.

A common problem with chemical mechanical polishing is the rapid wear on the parts as the substrates are polished. The retaining ring assembly mounted under the substrate carrier continually wears as the polishing pad makes direct contact against the featured substrate layer surfaces. Because the retaining ring assembly must be substantially parallel to the polishing pad during the polishing process to avoid surface irregularities, use of a worn ring assembly would create a defective product. Accordingly, frequent replacement of the retaining ring assembly on mechanical chemical polishers is a necessary and frequent occurrence.

The retaining ring assemblies on chemical mechanical polishers were previously constructed entirely of a plastic material. To add rigidity to the assembly, two-piece retaining ring assemblies were developed that comprised a lower or forward retaining ring portion formed of a plastic material that was permanently affixed to a stainless steel backing. The entire assembly could not be formed of stainless steel as the stainless steel would then contaminate the lapping. As a result, when the lower plastic retaining ring portion of the assembly became worn, the entire assembly still had to be discarded and replaced. Because of the high costs of these assemblies, frequent replacement represents a significant expense.

In an effort to reduce the costs of replacing these retaining ring assemblies, a detachable two-piece ring assembly was developed. Such an assembly employed a reusable annular ring backing formed of stainless steel and a resilient plastic retaining ring portion releasably secured to the backing by a dove-tailed snap fitment. Such a ring configuration is disclosed in U.S. Pat. No. 6,186,880 and enables the metal backing to be reused when the plastic retaining portion becomes overly worn and requires replacement. While such ring assemblies may reduce the cost of part replacement, the press fitment provided by the mating relationship between the retaining and backing rings requires tight tolerances. It also relies on the plastic material of which the retaining ring is constructed to effect the securement. Such material is notch sensitive so that any cracks in the material may cause the retaining ring to break upon being compressed as it is forced into the smaller channel in the metal backing. The material is also heat and chemically sensitive, which also can lead to destruction or damage of the retaining ring under the stresses of the snap fit attachment.

It would be highly desirable to provide a two-piece retaining ring assembly for use in chemical mechanical polishers which reduced the cost of part replacement by providing a releasable securement between the metal backing and plastic retaining ring portion but which did not require such tight tolerances in the ring, nor relied on the deformation of the plastic material to effect securement. The result would be a significant reduction in costs of part fabrication and in breakage problems resulting from material imperfections during assembly. The ring assembly of the present invention obtains these results.

SUMMARY OF THE INVENTION

Briefly, the present invention is directed to a retaining ring assembly for use in chemical mechanical polishers. The ring assembly comprises an annular backing ring formed of metal and annular retaining ring formed of a resilient plastic that is releasably secured to the backing by a pair of elongated coil springs sandwiched between and bearing against portions of the backing and the retaining ring.

The metal backing of the assembly defines an open, relatively wide annular channel in its lower surface. The depending side walls of the channel taper inwardly. The upper surface of the lower retaining ring portion of the assembly defines a raised annular projection having opposed lateral side walls that define relatively small inwardly directed, generally v-shaped, grooves therein. The transverse dimension of the channel in the annular backing is greater than that of the raised projection on the retaining ring portion. A pair of elongated coil springs are disposed in the small v-shaped grooves in the side walls of the annular projection on the retaining ring portion of the assembly and extend in a parallel disposition circumferentially about the raised projection. When the retaining ring and backing are combined such that the annular projection on the retaining ring portion and the springs carried thereby are forced into the annular channel in the assembly backing, the coil springs compress to allow the tapered channel walls to pass thereover and then expand radially and bear against the opposed channel and retaining walls, holding the two parts in an adjacent, secure, yet releasable attachment wherein the retaining ring portion could be replaced upon becoming worn without having to discard and replace the metal backing.

It is the principal object of the present invention to provide an improved retaining ring assembly for use in chemical mechanical polishers.

This and other objects and advantages of the present invention will become readily apparent from the following detailed description taken in conjunction with the accompanying drawings.

DETAILED DESCRIPTION OF THE PREFERRED EMBODIMENTS

Figure 1:
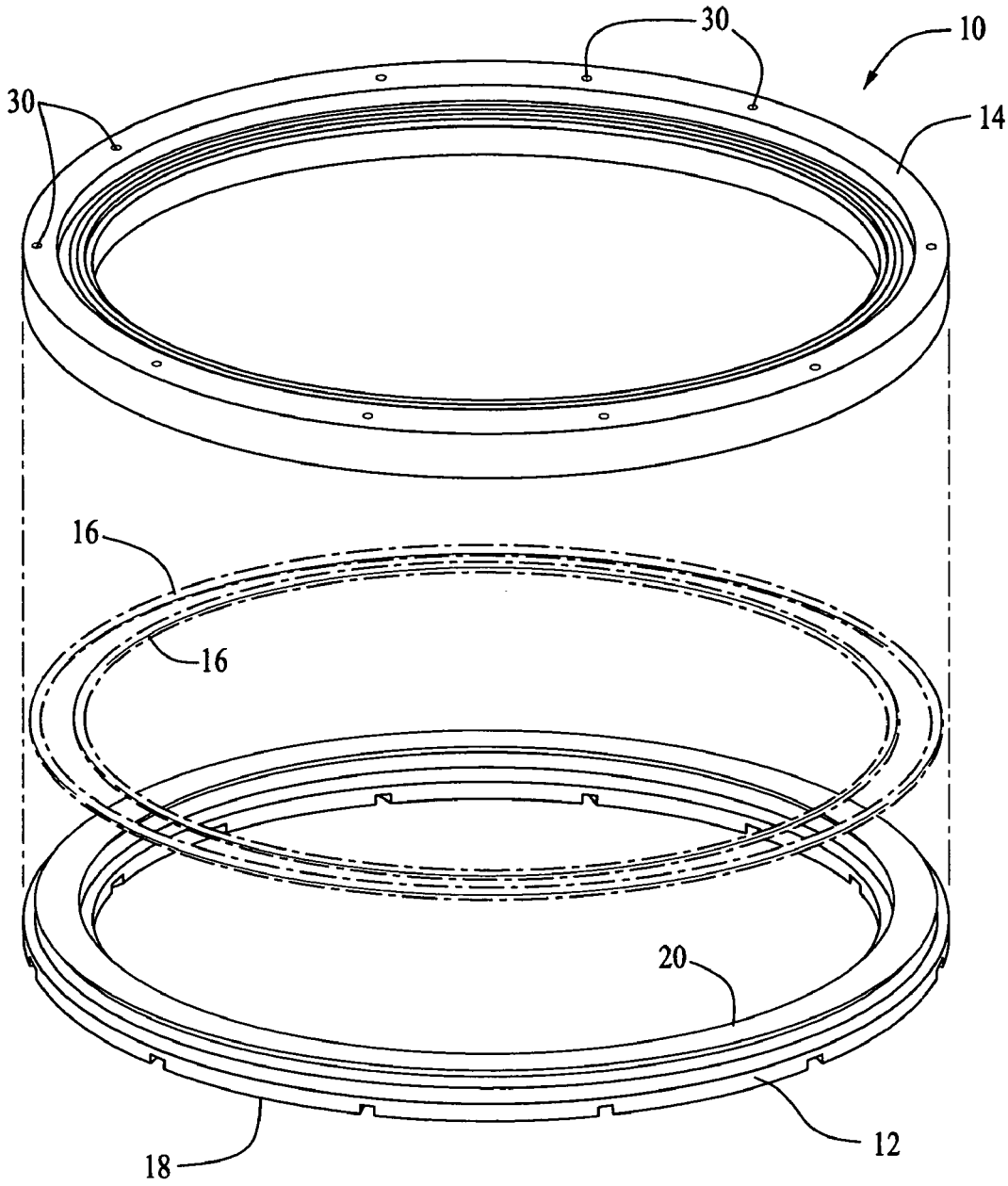
FIG. 1 is an exploded perspective view of the ring assembly of the present invention.
Figure 2:
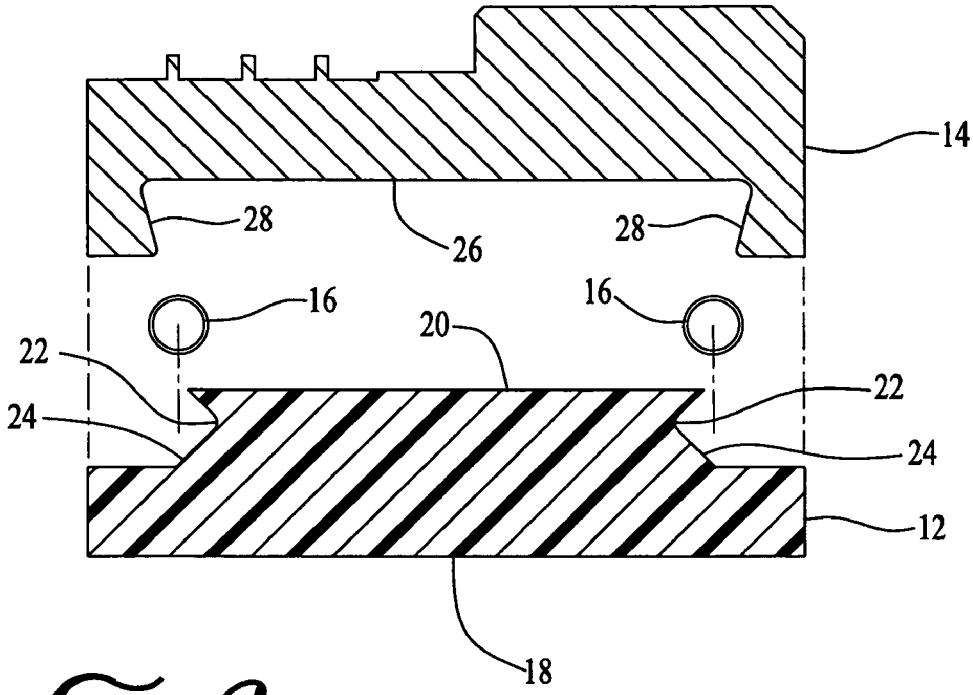
FIG. 2 is an exploded sectional view of the components of the ring assembly of the present invention.

The ring assembly 10 of the present invention comprises a retaining ring portion 12 constructed of a resilient plastic material such as polyphenylene sulfide (PPS), vespel and acetal, a backing ring portion 14 preferably constructed of stainless steel, and a pair of identically configured elongated securement springs 16 preferably formed of coiled stainless steel. The retaining ring portion 12 of assembly 10 defines a planar forward polishing surface 18, a raised annular projection 20 extending about and projecting upwardly or rearwardly therefrom and a pair of opposed inwardly tapered v-shaped grooves 22 formed in the side walls 24 of projection 20.

Figure 3:
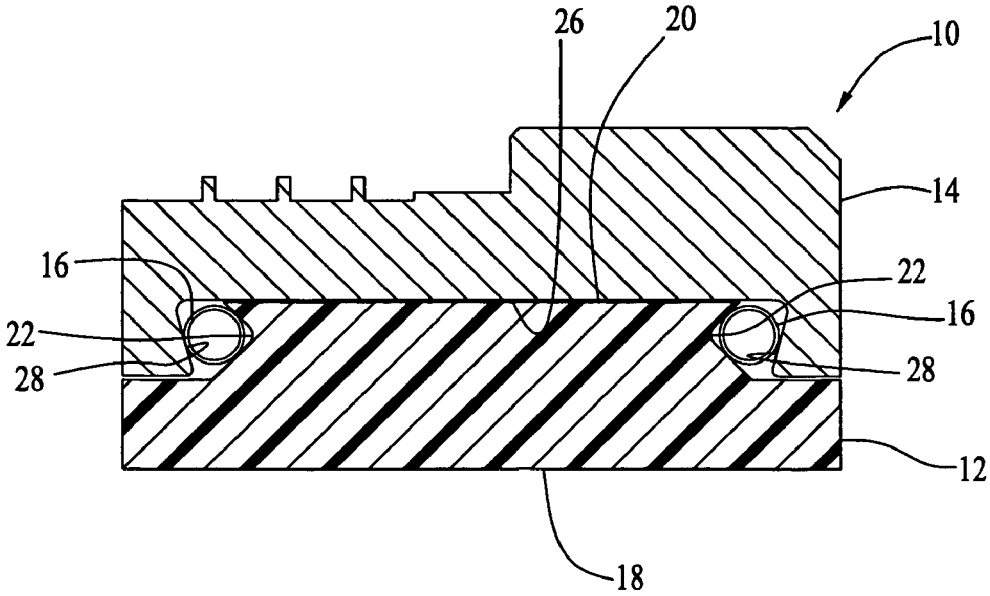
FIG. 3 is a cross-sectional view of an assembled ring assembly of the present invention.

The metal ring backing 14 defines a relatively wide open channel 26 in its lower surface. The depending side walls 28 of channel 26 preferably taper inwardly. Channel 26 is dimensioned such that when the raised annular projection 20 is disposed within channel 26, as seen in FIG. 3, the channel side walls 28 are spaced inwardly from the side walls 24 of projection 20 to accommodate the securement springs 16 that are carried by the annular projection 20 on the retaining ring 12. As seen in FIG. 3, springs 16 are disposed in the side wall grooves 22 of projection 20, project laterally therefrom for engagement by the channel walls 28 of back ring 14 and extend circumferentially about projection 20 in a concentric disposition.

By way of example, in a ring assembly having an outer diameter of about 10 in., an inner diameter of about 7 in. and a transverse dimension of about 0.750 in. The angle between the two inwardly tapered wall surfaces forming the v-shaped grooves 22 is about 45° and the angle between the substantially inverted v-shaped channel wall surfaces formed by the metal backing ring portion 14 is about 15°. The coil springs 16 are circular in cross section, define an outer diameter of about 0.100 in. and a lateral compressive spring force within the range of about 50 to 175 psi.

When the retaining ring 12 and backing 14 are forced together over the elongated coil springs 16, the springs compress laterally so as to allow the inwardly tapered channel wall 28 on the backing ring portion 14 to pass thereover. The resilient springs then quickly expand radially and bear against the opposed channel and retaining walls 26 and 28, holding the retaining ring portion 12 and backing ring portion 14 in adjacent disposition. Without the coil springs, the retaining ring would simply fall from the backing ring. With the coil springs 16, the two ring portions are held together in a precisely aligned, secure, yet releasable attachment whereby the retaining ring portion can be readily replaced upon becoming worn without having to discard the metal backing 14. If desired, pin holes 30 could be provided in the metal backing ring for receiving a release tool which could be inserted therethrough so as to abut the retaining ring and force the retaining ring from the backing to facilitate disassembly.

Various changes and modifications may be made in carrying out the present invention without departing from the spirit and scope thereof. Insofar as such changes and modifications are within the purview of the appended claims, they are to be considered as part of the present invention.

What is claimed is:

1. An annular ring assembly for use on a chemical mechanical polisher, said assembly comprising: an annular retaining ring defining an annular projection thereon, said projection defining opposed side walls and said side walls defining a pair of opposed inwardly directed substantially v-shaped grooves extending about said projection; an annular backing defining an open annular channel therein, said channel defining opposed tapered side walls and being adapted to receive said projection on said retaining ring upon said ring and said backing being urged into adjacent juxtaposition; and a pair of coil springs extending about said annular projection said springs being at least partially disposed within said v-shaped grooves in said projection and in compression between said projection and said side walls of said backing whereby said ring portion is releasably secured to said backing in a mated relationship.

2. The ring assembly of claim 1 wherein said retaining ring is constructed of a plastic material and said backing is constructed of metal.

3. An annular ring assembly for use on a chemical mechanical polisher, said assembly comprising: a lower annular retaining ring defining an annular projection thereon, said projection defining opposed side walls and said side walls defining a pair of opposed inwardly directed substantially v-shaped grooves extending about said projection; an upper annular backing defining an open annular channel therein, said channel defining opposed side walls and being adapted to receive said projection on said retaining ring upon said ring and said backing being urged into adjacent juxtaposition, said side walls on said backing being inwardly tapered so as to define a pair of opposed outwardly directed substantially v-shaped grooves therein, said outwardly directed grooves being spaced outwardly of and above said inwardly directed grooves on said retaining ring; and a pair of coil springs extending about said annular projection, each of said springs being at least partially disposed in a compressed disposition within and between an inwardly and an outwardly substantially v-shaped groove whereby said ring portion is releasably secured to said backing in a mating relationship.

4. The ring assembly of claim 3 wherein said retaining ring is constructed of a plastic material and said backing is constructed of metal.

* * * * *